United States Patent [19]

Häussler

[11] 4,370,934

[45] Feb. 1, 1983

[54] METHOD FOR PRODUCTION OF A COMPRESSION-PROOF SHELTER AND PREFABRICATED MEANS FOR USE IN THIS METHOD

[76] Inventor: Wilhelm Häussler, Residenzplatz 1, D-8960 Kempten, Fed. Rep. of Germany

[21] Appl. No.: 224,026

[22] Filed: Jan. 12, 1981

[30] Foreign Application Priority Data

Feb. 4, 1980 [DE] Fed. Rep. of Germany ..... 3003988
Oct. 18, 1980 [DE] Fed. Rep. of Germany ..... 3039465

[51] Int. Cl.[3] ..... E04H 9/04

[52] U.S. Cl. ..... 109/1 S; 52/169.6; 52/143; 52/236.9

[58] Field of Search ..... 109/1 S; 52/143, 122, 52/236.9, 169.6, 79.1, 136, 204, 270, 380, 404, 421, 503

*Primary Examiner*—Gene Mancene
*Assistant Examiner*—James R. Hakomaki
*Attorney, Agent, or Firm*—Offner and Kuhn

[57] ABSTRACT

In the production of a compression-proof shelter a semi-finished car garage is used consisting of reinforced lightweight thin concrete walls and being open at the front side. It is required that a personal living chamber is partitioned off against a filtering chamber by a compression-proof thick cross wall. If such a cross wall would be prefabricated the housing would become heavy and cannot easily be transported. Therefore only a pair of thin cross walls are installed leaving a hollow chamber therebetween. The housing is installed with all technical equipment and then is transported to the place of use and there the hollow chamber is filled with concrete avoiding any necessity to work within the housing. The cross wall can be prefabricated with all necessary technical equipment and is pushed into the housing before or after having been transported to the place of use.

13 Claims, 5 Drawing Figures

METHOD FOR PRODUCTION OF A COMPRESSION-PROOF SHELTER AND PREFABRICATED MEANS FOR USE IN THIS METHOD

BACKGROUND OF THE INVENTION

Prefabricated shelters are known in which a thick-wall spherical housing forming a person chamber is separated from a filtering chamber and connected by ventilation conduits. It would be better to combine that two chambers in the same housing and partition-off one against the other by a compression-proof wall. However such constructions would be too heavy and cannot be reasonably transported to the place of use.

BRIEF SUMMARY OF THE INVENTION

Therefore one object of the present invention is to provide a new method to produce relatively large compression-proof shelters with low costs allowing an easy transpartation to the place of use.

A further object is to provide a method which allows prefabrication of a housing and all technical equipment avoiding any necessity to work within the housing after having it transported to the place of use.

A further object is to provide a housing having a filtering chamber and a person chamber and light-weight partition means therebetween which can be made compression-proof after transportation to the place of use.

A further object is to provide a method for production of a shelter in which available housings can be used for example box-like automobile garages.

A still further object is to provide a method for production of a shelter in which a prefabricated thin-walled box-like housing is used containing all necessary technical equipment and which is used as an inner shuttering after transportation to the place of use, when forming a thick-wall concrete casing and in the same working process a compression-proof partition is formed within the housing without the necessity to get access of the interior of the housing.

One further object is to provide an at least semi-finished cross-wall-element containing all technical equipment for ventilation etc. and which can be easily pushed into a prismatic housing and fixed at a predetermined place whereafter the front opening the housing is closed by a front plate.

Further objects, features and advantages of the invention result from the following description.

DESCRIPTION OF THE PREFERRED EMBODIMENTS

Figure 1:
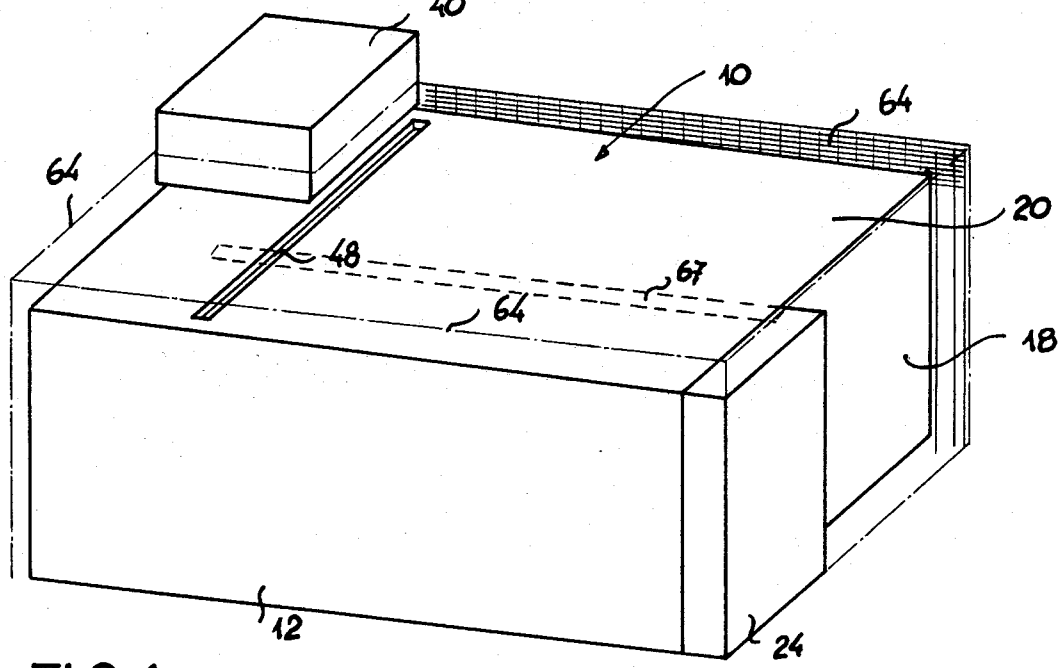
FIG. 1 shows a perspective view of a housing containing all technical equipment and ready for transportation to the place of use.
Figure 2:
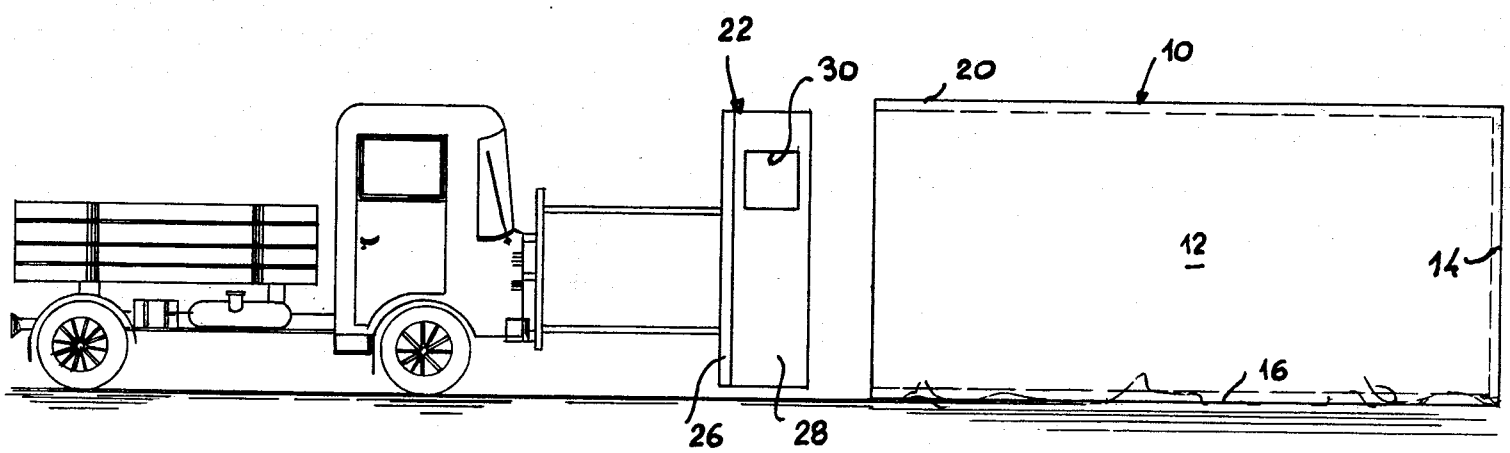
FIG. 2 shows a side view of the housing during assembling a pre-fabricated insert element.

A housing 10 of substantially prismatic form comprises a pair of side walls 12, 12, a rear wall 14, a floor 16, a front wall 18, and a ceiling 20 which has a small rearward inclination with respect to the floor. An insert element 22 comprises a heavy thick-wall compression-proof cross wall 26 and a short longitudinal wall 28 which protrudes rectangularly from the cross-wall. The width and the height of the element 22 correspond to the inner dimensions of the housing 10. The longitudinal wall 28 serves to partition off a filtering chamber against an emergency exit chamber and comprises an man-hole or opening 30 closed by a door. The element 22 is provided with substantially all technical equipment, as a filtering system, ventilation conduits, fittings, condensation outlet, electrical connections, a lightening plant and so on. As shown in FIG. 2 the element is pushed into the front side open housing 10 by a truck or a crane until the longitudinal wall 28 abuts on the rear wall 14. The ceiling 20 has an exit opening (not shown) above the emergency exit chamber. This opening is surrounded by a box 40 fastened on the ceiling and provided with an air-tight movable cover for the opening. The cross wall 26 is grooved along its upper edge surface and along its pair of vertical edge surfaces. These grooves communicate with a cross-wise extending slot 48 in the ceiling when the element 22 is in its end position. A second cross-wise extending partition can be inserted in the same way to limit a living chamber for persons and this partition is provided with a door. Then the front opening is closed as shown in FIG. 4 by a front plate 18 provided with door-box 24. The front plate is provided with longitudinally protruding fastening plates 58 which can welded at plates 60 anchored at the outer circumference of the housing. A profile rail 67 is embedded into the ceiling and flush with the inner surface of which. The element can be provided with a slide 68 (FIG. 3) vertically above the centre of gravity and the slide 68 can be inserted in the rail 67 and the element 22 then is pushed into position as mentioned above. The housing 10 and the element 22 and the front plate 18 are transported separately to the place of use and the element is inserted there. Then a thick concrete casing is applied to the housing. Concrete runs through the slit 48 into the aforementioned grooves, whereby a tight connection between the cross wall 26 and the walls 12, 12 of the housing is gained. The bottom gap below the cross wall is sealed separately.

Figure 3:
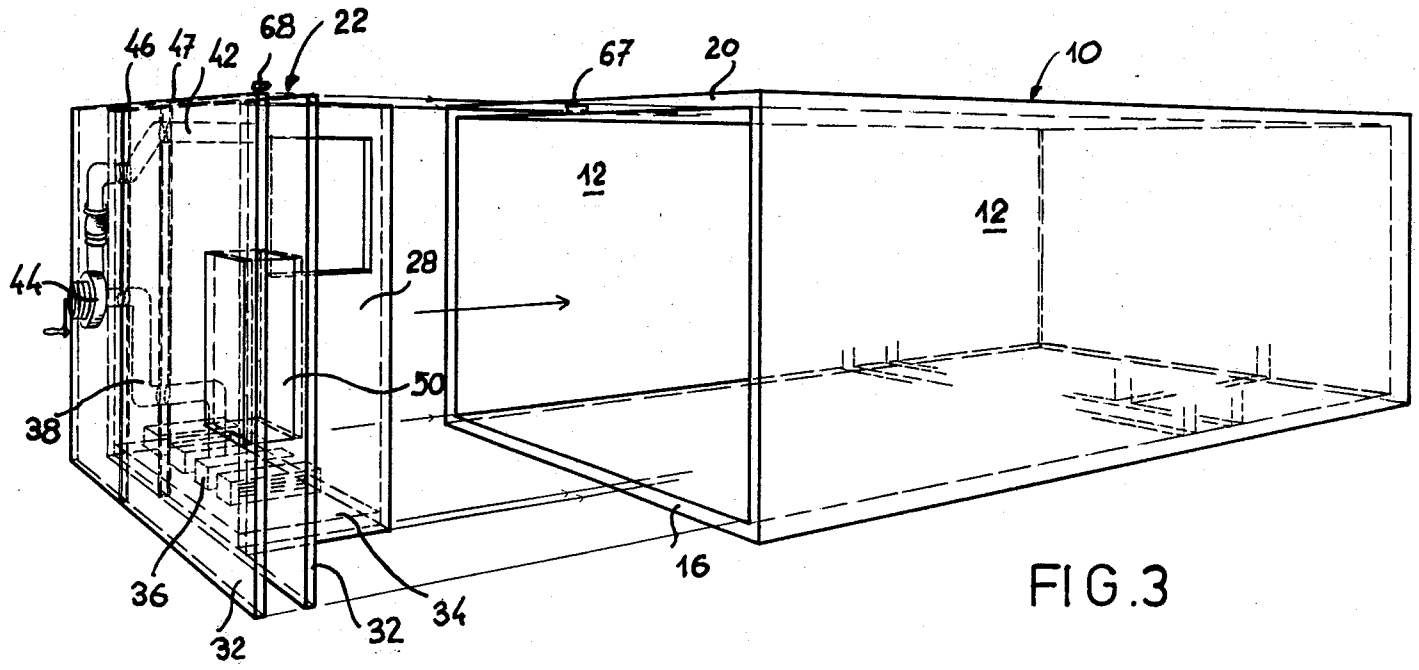
FIG. 3 shows a perspective view of the housing and an alternative embodiment of a pre-fabricated element in greater detail.
Figure 4:
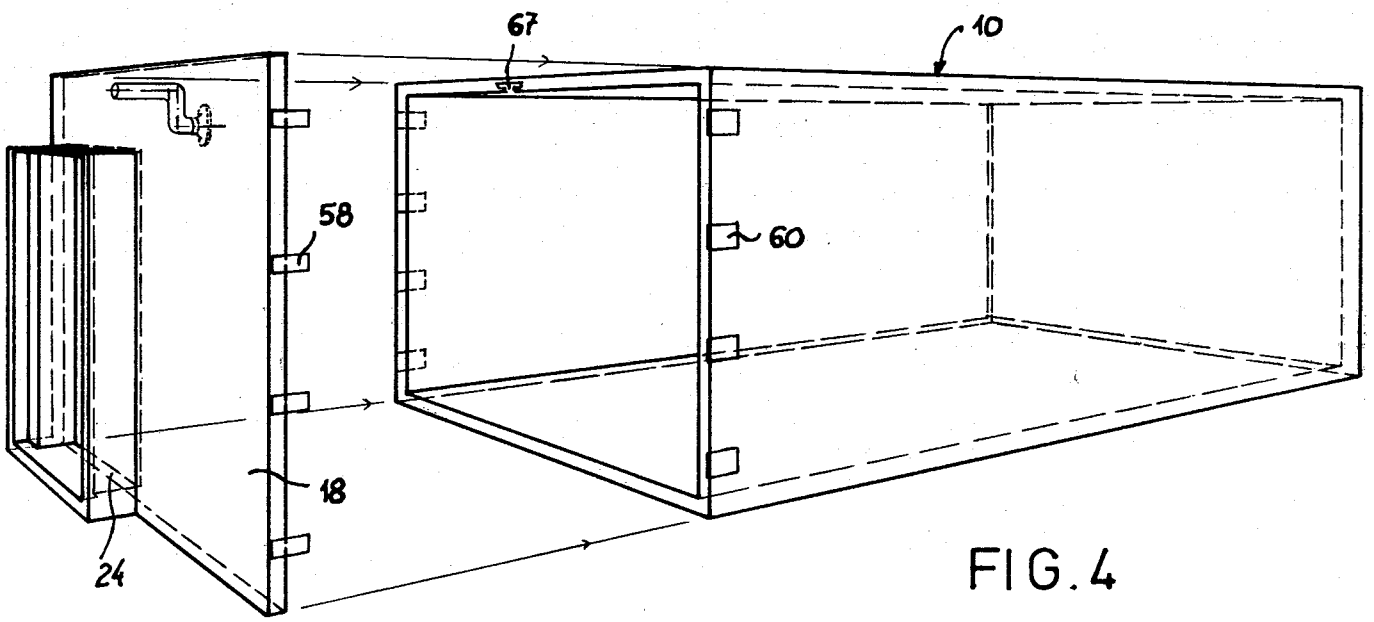
FIG. 4 shows the mode of closing the housing by a front plate after having assembled the cross-wall element of FIG. 3.

A preferred insert element 22 is shown in FIG. 3. It consists of a pair of thin-wall cross walls 32, 32 spaced apart by a plurality of spacers. The cross walls consist of reinforced concrete, metal sheet, asbestos cement or the like and form a dead or lost shuttering. The interspace between the cross walls corresponds to the thickness of the solid cross wall 26 of FIG. 2. The insert element 22 of FIG. 3 also is provided with the longitudinal wall 28.

A bottom plate 34 is connected at the left side of the wall 28 and connected with the leading cross wall 32. A plurality of filtering elements 36 are arranged on the bottom plate 34 and are connected with a ventilation conduit 38 which passes through the pair of cross walls 32, 32 and is connected with a hand-operated air pump 44 arranged on the opposite side of the pair of cross walls at the outer surface of the trailing wall 32. A second air tube 42 extends from the chamber on the right side of the longitudinal wall 28 into the left side filtering chamber and then passes through the pair of cross walls 32, 32 in the same vertical plane as the tube 38 and is connected too with the pump 44. The cross wall element 22 is divided into at least two parts which abut on one another in the vertical plane containing the tubes 38, 42 as shown at 46, 47 in order to simplify assembling work. At the right hand portion of the insert element 22 a door or corridor box 50 extends between the pair of cross walls 32, 32 in order to provide an access of the emergency exit chamber from the main chamber. The box is closed by an air-tight door (not shown).

The insert element 22 can be pushed into position within the housing as shown with dashes in FIG. 3 at the working station and the housing then can be finished with the front plate before transporting the housing to the place of use because the over-all weight is low enough.

Figure 5:
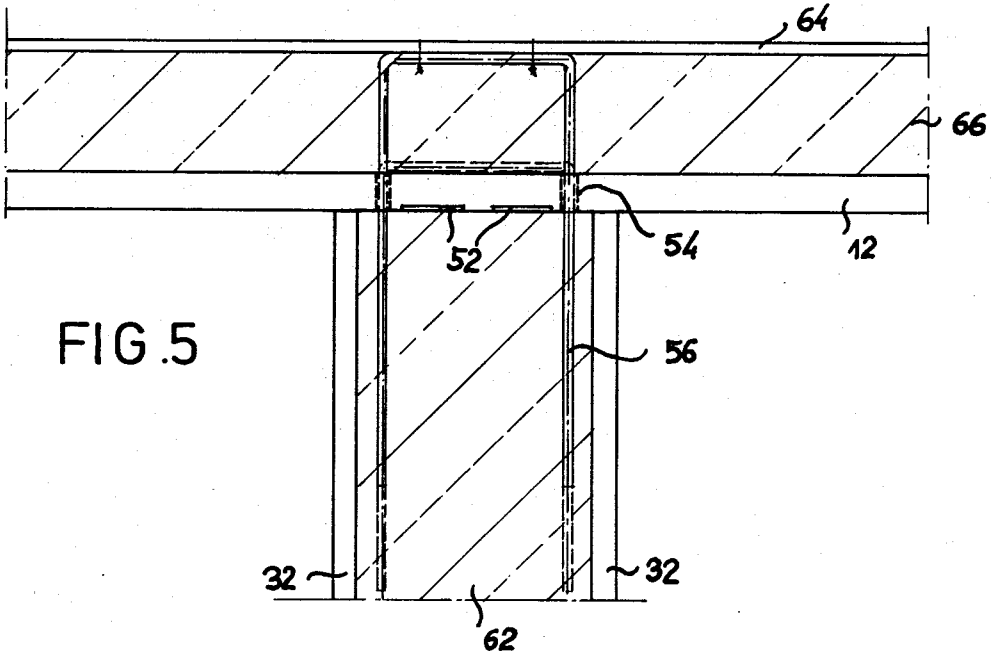
FIG. 5 shows a horizontal cross-section of the connection of the cross wall with the concrete outer casing.

The inner surfaces of the side walls 12, 12 are roughened in the region of the cross walls element 22 or are provided with vertical grooves or recesses. For example ribbed plates or strips 52 are anchored in the walls (FIG. 5). The same can be true for the floor 16 and the corner areas of the ceiling. A plurality of pairs of bores 54 are provided in the side walls respectively at that region which corresponds to the place of the cross wall element 22. Reinforcement or trussing steel bows 56 are inserted into the pairs of bores 54.

During the transport of the housing to the place of use the steel bows 56 contact the outer surfaces of the walls 16 as shown in dashes. At the place of use the bows 56 are extended outwardly by a length equal with the thickness of the outer concrete casing to be formed. The outer ends of the bows are fastened at an outer shuttering 64 which surrounds the housing 10. In the walls 12, 12, 14, 18 anchoring elements are embedded provided with hooks or rings at the outer surfaces of the walls. In the hooks or rings struts are pivoted to the ends of which the shuttering plates 64 are connected. The shuttering plates 64 therefore can be assembled already at the working station and can be swung in contact with the walls of the housing for transport purposes and need only be swung outwardly to finish the shuttering at the place of use.

To complete the shelter concrete is poured through the slit 48 and the space between the cross walls 32, 32 is filled. The ribbed strips 52 provide for a good adhesion of the concrete wall 62 formed thereby. The steel bows 56 provide for a compression-proof connection of the cross wall 62 with the outer concrete casing 66.

I claim:

1. A method for producing a shelter in the form of an oblong prismatic housing having at least one compression-proof cross wall of a large thickness within the housing partitioning off a person chamber from an air filtering chamber and/or an emergency exit chamber, the method comprising the steps: Providing at least one opening in that portion of the ceiling of a light-weight housing and/or at least one longitudinal wall adjacent said ceiling corresponding to the position of the cross wall; arranging a dead or lost cross shuttering means consisting of a pair of thin walls within said housing, connection means mounted or mounting at the shuttering means and extending from one side of which to the other side, said connection means at least comprising spacer elements, ventilation conduit means and a passage or corridor box; transporting the housing from the working place to the place of use before or after having arranged the shuttering means; pouring concrete through the opening into the shuttering means and thereby forming a compression-proof cross wall at the place of use of the shelter; and using the housing as an inner shuttering when forming a compression-proof cover by surrounding walls of reinforced concrete.

2. A pre-fabricated housing for use in the production of a compression-proof shelter, comprising a substantially prismatic oblong light-weight box of reinforced concrete consisting of a pair of side walls, a rear wall, a ceiling and a floor in form of a semi-finished car garage, partition means within the box parallely arranged with respect to the rear wall and connecting said pair of side walls, the ceiling and the floor; the partition means partitioning off a main person chamber from an air filtering and an emergency exit chamber, the partition means comprising a pair of parallel cross walls forming a dead mold, an opening in the ceiling above said dead mold and connecting means connecting said pair of cross walls with one another, said connecting means at least comprising spacer elements, at least one ventilation conduit and a man-passage or corridor box.

3. A housing as claimed in claim 2, wherein an air filtering means is provided in the filtering chamber between the partition means and the rear wall, the filtering means is operatively connected with the ventilation conduit.

4. A housing as claimed in claim 2, wherein a man-hole is provided in the ceiling at one corner thereof between the rear wall and the partition means and a cap is mounted on the ceiling surrounding the man-hole and comprising a movable cover closing the man-hole.

5. A housing as claimed in claim 2, wherein a plurality of reinforcement steel elements are provided at the outside surfaces of at least the vertical walls of the housing, the ends of said elements are connected or connectable with outer shuttering plates, the steel elements preferably are pivotably connected or connectable with anchoring elements embedded in the walls.

6. A housing as claimed in claim 2, wherein the inner surfaces of the side wall between said pair of cross walls are roughened or are provided with ribbed strips or plates.

7. A housing as claimed in claim 2, wherein the pair of cross walls are divided into sections which abut against one another in planes containing the ventilation conduit and/or the passage or corridor box.

8. A housing as claimed in claim 2, wherein reinforcement steel elements protrude from the inner surfaces of the side walls between said pair of cross walls.

9. A prefabricated cross wall element for insertion into a front side open housing in the form of a car garage in order to partition off a main chamber from a filtering and/or emergency exit chamber, the cross wall element corresponding in its width and height to the respective inner dimensions of the housing and its thickness being much greater than that of the housing walls, the element comprising a ventilation system passing through the cross wall element and an air filtering means mounted at one side of the element and connected with the ventilation system, the element further comprising a man-hole corridor box passing from one side of the element to the other side of which.

10. A cross wall element as claimed in claim 9, wherein it is composed of a pair of thin-walled cross walls connected by spacer elements.

11. A cross wall element as claimed in claim 9, wherein a hanger protrudes upwardly from the element at a point vertically above the centre of gravity of which for cooperation with a suspension slide rail embedded in the ceiling of the housing.

12. A cross wall element as claimed in claim 9, wherein a partition wall of a lower thickness as compared with its own thickness is rectangularly fastened at the element forming a T-shaped structure of a constant height, the air filtering means being fastened at one side of the partition wall and the corridor box being provided at the other side of which, and the partition wall is provided with a man-hole.

13. A cross wall element as claimed in claim 9 or 12, wherein a bottom wall protrudes from the element on which the filtering means are mounted.

* * * * *